US007261807B2

(12) United States Patent
Henry et al.

(10) Patent No.: US 7,261,807 B2
(45) Date of Patent: Aug. 28, 2007

(54) FLUID CAT CRACKING WITH HIGH OLEFINS PRODUCTION

(75) Inventors: B. Erik Henry, Baton Rouge, LA (US); William A. Wachter, Flemington, NJ (US); George A. Swan, III, Baton Rouge, LA (US)

(73) Assignee: ExxonMobil Research and Engineering Co., Annandale, NJ (US)

( * ) Notice: Subject to any disclaimer, the term of this patent is extended or adjusted under 35 U.S.C. 154(b) by 199 days.

(21) Appl. No.: 10/131,737

(22) Filed: Apr. 24, 2002

(65) Prior Publication Data

US 2002/0189973 A1 Dec. 19, 2002

Related U.S. Application Data

(63) Continuation-in-part of application No. 09/222,864, filed on Dec. 30, 1998, now abandoned.

(51) Int. Cl.

| | |
|---|---|
| ***C10G 11/00*** | (2006.01) |
| ***C10G 11/14*** | (2006.01) |
| ***C10G 11/02*** | (2006.01) |
| ***C10G 11/04*** | (2006.01) |

(52) U.S. Cl. ..... 208/113; 208/106; 208/114; 208/118; 208/119; 208/78; 208/74

(58) Field of Classification Search ..... 208/106, 208/113, 114, 118, 119, 78, 74
See application file for complete search history.

(56) References Cited

U.S. PATENT DOCUMENTS

| | | | | |
|---|---|---|---|---|
| 3,894,935 | A * | 7/1975 | Owen | 208/78 |
| 3,928,172 | A | 12/1975 | Davis, Jr. et al. | 208/77 |
| 3,974,062 | A * | 8/1976 | Owen et al. | 208/74 |
| 5,318,694 | A | 6/1994 | Maher et al. | 208/120 |
| 5,601,699 | A | 2/1997 | Degnan et al. | 208/114 |
| 5,730,859 | A * | 3/1998 | Johnson et al. | 208/78 |
| 5,888,378 | A | 3/1999 | Kowalski | 208/114 |
| 6,113,776 | A | 9/2000 | Upson | 208/113 |

OTHER PUBLICATIONS

Niccum et al., Maxofin: A Novel FCC Process for Maximizing Light Olefins Using a New Generation of ZSM-5 Additive, Mar. 16, 1998, pp. 1-13.

* cited by examiner

*Primary Examiner*—Tam M. Nguyen
(74) *Attorney, Agent, or Firm*—Erika S. Wilson; Gerard J. Hughes

(57) ABSTRACT

The propylene production of a fluid catalytic cracking unit employing a large pore zeolite cracking catalyst, produces more propylene by adding a naphtha cracking riser and a medium pore zeolite catalytic component to the unit, and recycling at least a portion of the naphtha crackate to the naphtha riser. The large pore size zeolite preferably comprises a USY zeolite and the medium pore size is preferably ZSM-5. Propylene production per unit of naphtha feed to the naphtha riser is maximized, by using the 60–300° F. naphtha crackate as the feed.

23 Claims, 1 Drawing Sheet

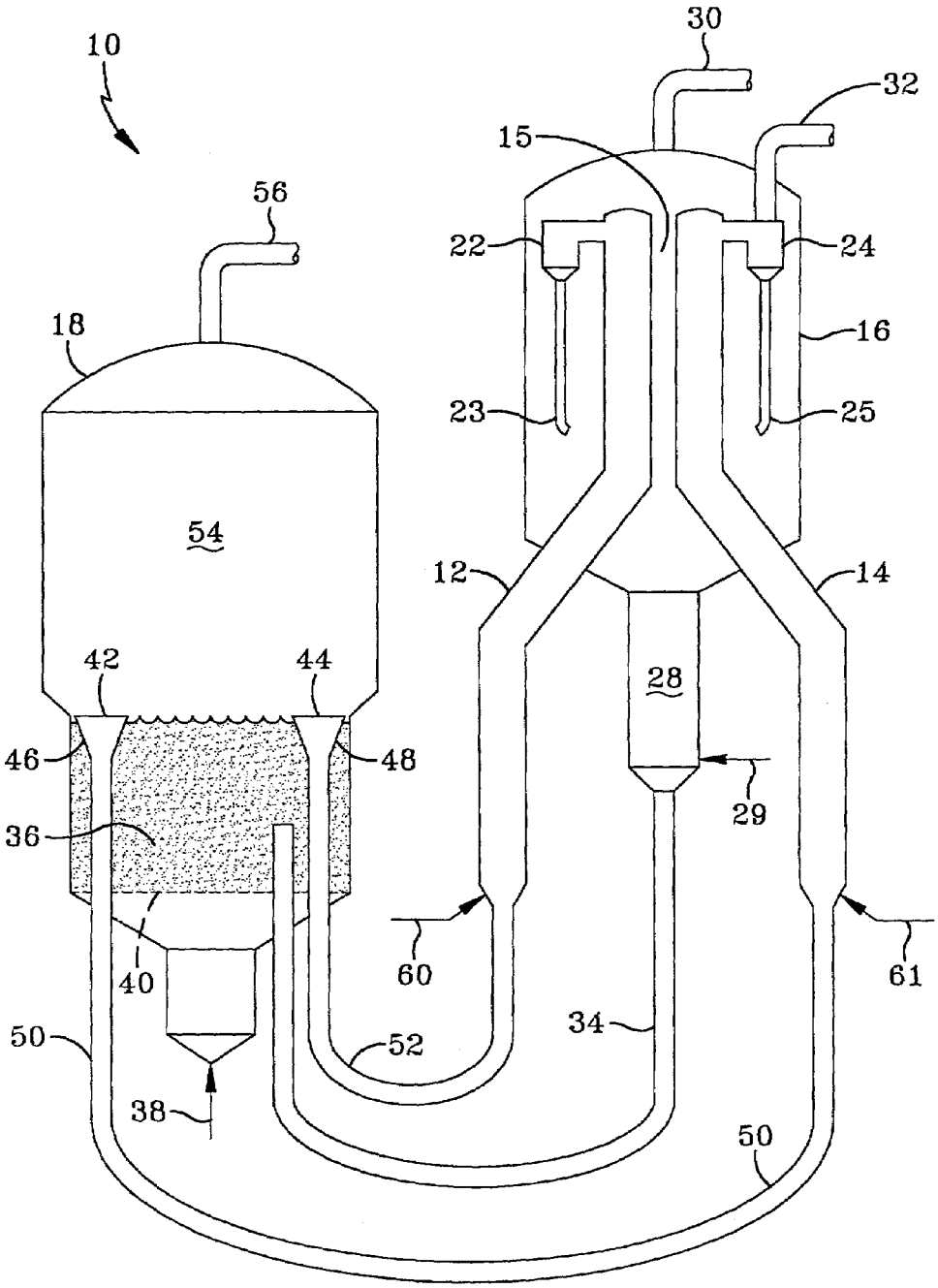
10
30
32
15
56
22
24
18
16
23
25
54
12
14
42
44
28
46
48
29
36
60
61
40
34
50
52
38
50

FLUID CAT CRACKING WITH HIGH OLEFINS PRODUCTION

CROSS-REFERENCE TO RELATED APPLICATION

This application is a continuation-in-part of U.S. patent application Ser. No. 09/222,864 filed Dec. 30, 1998 now abandoned.

FIELD OF THE INVENTION

The invention relates to a fluid cat cracking process for high olefins production, using a combination of dual risers and a cracking catalyst containing both large and medium pore zeolites. More particularly, the invention relates to a fluid cat cracking process using a cracking catalyst having faujasite and ZSM-5 components, to produce reaction products comprising light olefins and naphtha in a first riser. At least a portion of the naphtha is recovered and passed into a second riser, in which it is catalytically cracked to produce more light olefins.

BACKGROUND OF THE DISCLOSURE

The demand for light olefins, such as propylene and butylenes, and particularly propylene, is increasing faster than present plant capacity. A major source of propylene is from fluid cat cracking (FCC) processes. Fluid cat cracking is an established and widely used process in the petroleum refining industry, primarily for converting petroleum oils of relatively high boiling point, to more valuable lower boiling products, including gasoline and middle distillates such as kerosene, jet fuel and heating oil. In an FCC process, a preheated feed is brought into contact with a hot cracking catalyst, which is in the form of a fluidized, fine powder, in a reaction zone which comprises a riser. Cracking reactions are extremely fast and take place within three to five seconds. The heavy feed is cracked to lower boiling components, including fuels, light olefins, and coke. The coke and cracked products which are not volatile at the cracking conditions, deposit on the catalyst. The riser exits into a separator-stripper vessel, in which the coked catalyst is separated from the volatile reaction products and stripped with steam. The stream strips off the strippable non-volatiles and the stripped catalyst is passed into a regenerator in which the coke and any remaining hydrocarbonaceous material are burned off with air, or a mixture of air and oxygen, to form a regenerated catalyst. This regeneration heats the catalyst for the cracking reactions and the hot, regenerated catalyst is returned to the riser reaction zone. The process is continuous. Thus, a typical FCC cracking unit includes (i) a riser (ii) a separation-stripping vessel and (iii) a regeneration vessel. Some FCC units include two risers, so as to have two reaction zones for catalytically cracking the FCC feed, in association with a single separation-stripping vessel and a single catalyst regeneration vessel. Feeds commonly used with FCC processes are gas oils which are high boiling, non-residual oils and include straight run (atmospheric) gas oil, vacuum gas oil, and coker gas oils. Typical FCC cracking catalysts are based on zeolites, especially the large pore synthetic faujasites, such as zeolites X and Y. The olefins yield from the cracking reaction is limited by the process and cracking catalyst. U.S. Pat. No. 3,928,172 discloses an FCC process with increased light olefin production. The process includes a cracking catalyst containing faujasite and ZSM-5 zeolite components, a first riser for cracking the FCC feed and a second riser for cracking naphtha produced in the first riser. Cracking the naphtha in the second riser produces more olefins and improves the naphtha octane. In all the embodiments, the second riser is associated with a separate or outboard vessel, and not with the separation-stripping vessel used with the first riser. While it is possible to build a new FCC unit with additional risers and vessels for increased light olefins production, it is extremely costly to add additional vessels to an existing FCC unit. Therefore, it would be beneficial to be able to increase the light olefins yield from an existing FCC unit, without having to add additional vessels to the unit.

SUMMARY OF THE INVENTION

The invention relates to a fluid cat cracking (FCC) process having increased production of light olefins, including propylene, using at least two risers feeding into a single separation-stripping vessel and a cracking catalyst comprising both large and medium pore, shape-selective zeolite components. The FCC feed is catalytically cracked to produce a crackate which comprises naphtha and propylene in a first riser, with recovery and recycle of at least a portion of the naphtha crackate as feed into a second riser, in which it is catalytically cracked into products comprising additional propylene. While the naphtha crackate passed into the second riser may comprise the entire $C_5$-430° F. boiling naphtha fraction in the practice of the invention, it has been found that more propylene-containing light olefins are produced per unit of the naphtha crackate feed passed into the second riser, by using the lighter, $C_5$-≦300° F. fraction, which typically boils in the range of 60–300° F. (15–149° C.). While some heavier naphtha components boiling above 300° F. may be present in the embodiment in which the feed to the second riser reaction zone comprises the light naphtha fraction, it is preferred that it be present in an amount of less than 50 wt. %, preferably less than 25 wt. % and still more preferably less than 10 wt. % of the naphtha feed. The large pore zeolite component is preferably a faujasite type and more preferably a Y type faujasite. The medium pore zeolite component is preferably a ZSM-5 type. It is also preferred that the catalyst contain a phosphorus component. In addition to the large and medium pore size zeolite components, the catalyst will also include at least one porous, inorganic refractory metal oxide as a binder. It is preferred that the binder have acid cracking functionality, for cracking the heavier components of the FCC feed and that the medium pore size zeolite component comprise at least 1 wt. % of the catalyst, on a total weight basis. In a particularly preferred embodiment, the large pore zeolite component will comprise an ultrastable zeolite Y, with a unit cell size no greater than 24.30 Å and preferably no greater than 24.26 Å, and the medium pore zeolite will comprise ZSM-5. It is also preferred that the catalyst contain at least 0.5 wt. % phosphorus, typically present as $P_2O_5$. In one embodiment, which is a preferred embodiment, the catalyst will comprise particles comprising the large pore size zeolite, composited with a porous, inorganic refractory metal oxide binder and particles comprising the medium pore size zeolite, composited with a porous, inorganic refractory metal oxide binder. In another embodiment, the catalyst particles may comprise both the large and medium pore zeolite components composited with a porous, inorganic refractory metal oxide binder, in a single particle.

The process is conducted in an FCC unit having a regeneration zone, a separation zone, a stripping zone and at least two separate cracking reaction zones, both of which pass the crackate products and spent catalyst into the same separation and stripping zones. At least one reaction zone will be for the FCC feed and at least one for the naphtha crackate feed produced in the first reaction zone. As a practical matter, each reaction zone will comprise a separate riser, with both the separation and stripping zones being in the same vessel, and the regeneration zone will be in a regenerator vessel. Most of the reaction products in the cracking zones are vapors at the cracking conditions and are passed into the separation zone, along with the spent catalyst, where they are separated from the catalyst particles and passed to further processing and recovery. The separation zone contains suitable means, such as cyclones, for separating the spent catalyst particles from the crackate vapors. The cracking reactions result in the deposition of strippable hydrocarbons and non-strippable hydrocarbonaceous material and coke, onto the catalyst. The catalyst is stripped in the stripping zone, using a suitable stripping agent, such as steam, to remove the strippable hydrocarbons, which are passed into the separation zone with the stripping agent and combined with the crackate vapors. The stripped catalyst particles are then passed into the regeneration zone, where the coke and non-strippable hydrocarbonaceous material is burned off with oxygen, as either air or a mixture of oxygen and air, to form hot, regenerated catalyst particles, which are then passed back into each cracking reaction zone. In a preferred embodiment, the reaction products from the naphtha cracking zone are not combined with the first or FCC feed cracking zone products, or the stripped hydrocarbons, but are passed to separate separation means in the separation vessel. The invention is therefore a combination of the catalyst, process and the use of at least two riser reaction stages associated with one separation zone and one stripping zone, preferably in the same vessel. The invention may be practiced with an existing FCC unit to which has been added a second riser reaction zone, or with a new unit having two risers. Thus, the practice of the invention permits increasing production of propylene-containing light olefins with an existing FCC unit, without having to add an additional vessel, and comprises the steps of:

(a) contacting an FCC feed with a hot, regenerated, particulate cracking catalyst comprising both large and medium pore zeolite components in a first cracking reaction zone at reaction conditions effective to catalytically crack said feed and produce lower boiling hydrocarbons comprising naphtha, propylene-containing light olefins, and spent catalyst particles which contain strippable hydrocarbons and coke;

(b) separating said lower boiling hydrocarbons produced in step (a) from said spent catalyst particles in a separation zone and stripping said catalyst particles in a stripping zone, to remove said strippable hydrocarbons to produce stripped, coked catalyst particles, wherein said separation and stripping zones are in the same vessel;

(c) contacting at least a portion of said naphtha produced in said first reaction zone with said hot, regenerated, particulate cracking catalyst in a second cracking reaction zone, at reaction conditions effective to catalytically crack said naphtha and produce lower boiling hydrocarbons comprising more propylene-containing light olefins and spent catalyst particles which contain strippable hydrocarbons and coke;

(d) separating said lower boiling hydrocarbons from said spent catalyst particles in said separation zone and stripping said particles in said stripping zone, to remove said strippable hydrocarbons to produce stripped, coked catalyst particles;

(e) passing said stripped, coked catalyst particles produced in steps (b) and (d) into a regeneration zone in which said particles are contacted with oxygen at conditions effective to burn off said coke and produce said hot, regenerated catalyst particles, and (f) passing said hot, regenerated catalyst particles into said first and second cracking reaction zones, wherein said first and second zones are in separate first and second risers.

The separated, lower boiling hydrocarbons produced in each cracking zone are passed to product recovery operations, which typically include condensation and fractionation, to condense and separate the hydrocarbon products of the cracking reactions into the desired boiling range fractions, including naphtha and light olefins. By light olefins in the context of the invention, is meant comprising mostly $C_2$, $C_3$ and $C_4$ olefins. In preferred embodiments, (i) the catalyst will comprise the preferred catalytic components referred to above, (ii) the naphtha feed to the second riser will boil within the range of from 60–300° F. (15–149° C.) for maximized light olefins production, and (iii) the reaction products of the cracking reactions in the second riser will not be mixed with the first riser reaction products, but will be passed to separate product recovery. The naphtha riser reaction products will be sent to the same separation vessel as the FCC feed riser reaction products, but will be passed into a different separation means within said vessel, from which the separated hydrocarbon vapors are removed. In a further embodiment, steam may also be injected into the naphtha riser cracking reaction zone, either admixed with the naphtha feed or separately injected. Propylene yield from the process of this invention may be up to three times that of a typical FCC process without the naphtha crackate riser reaction zone.

BRIEF DESCRIPTION OF THE DRAWING

The FIGURE schematically illustrates an FCC unit useful in the practice of the invention, in which dual risers are employed in association with a single separation-stripping vessel.

DETAILED DESCRIPTION

Cat cracker feeds used in FCC processes typically include gas oils, which are high boiling, non-residual oils, such as a vacuum gas oil (VGO), a straight run (atmospheric) gas oil, a light cat cracker oil (LCGO) and coker gas oils. These oils have an initial boiling point typically above about 450° F. (232° C.), and more commonly above about 650° F. (343° C.), with end points up to about 1150° F. (621° C.). In addition, one or more heavy feeds having an end boiling point above 1050° F. (e.g., up to 1300° F. or more) may be blended in with the cat cracker feed. Such heavy feeds include, for example, whole and reduced crudes, resids or residua from atmospheric and vacuum distillation of crude oil, asphalts and asphaltenes, tar oils and cycle oils from thermal cracking of heavy petroleum oils, tar sand oil shale oil, coal derived liquids, syncrudes and the like. These may be present in the cracker feed in an amount of from about 2 to 50 volume % of the blend, and more typically from about 5 to 30 volume %. These feeds typically contain too high a content of undesirable components, such as aromatics and compounds containing heteroatoms, particularly sulfur and nitrogen. Consequently, these feeds are often treated or upgraded to reduce the amount of undesirable compounds by processes, such as hydrotreating, solvent extraction, solid absorbents such as molecular sieves and the like, as is known. Hydrotreating comprises contacting the feed with hydrogen in the presence of a suitable catalyst, such as a supported catalyst containing a Mo catalytic component, with Ni and/or Co catalytic components, at conditions effective for the hydrogen to react with the undesirable feed components and thereby remove them from the feed, as is well known.

Typical cracking catalysts useful in FCC processes have one or more porous, inorganic refractory metal oxide binder materials or supports, which may or may not contribute to the desired cracking activity, along with one or more zeolite components. As set forth under the SUMMARY, in the process of this invention, the cracking catalyst comprises both large and medium pore, shape-selective zeolite components, along with at least one inorganic, refractory metal oxide component and preferably including a phosphorous component. By large pore size zeolite is meant a porous, crystalline aluminosilicate having a porous internal cell structure in which the cross-sectional dimensions of the pores broadly range from 6 to 8 Å and even greater in the case of mesoporous structural types, preferably from 6.2 to 7.8 Å and more preferably from 6.5 to 7.6 Å. The cross-sectional dimensions of the porous internal cells of the medium pore size zeolite component will broadly range from 4 to 6 Å, preferably 4.3 to 5.8 Å, and more preferably from 4.4 to 5.4 Å. Illustrative, but non-limiting examples of large pore zeolites useful in the process of the invention include one or more of the FAU structural types such as zeolite Y, EMT structural types such as zeolite CSZ-1, MOR structural types such as mordenite, and mesoporous structural types with pore diameters greater than 8 Å. Similarly, the medium pore zeolite component may comprise one or more of the MFI structural type such as ZSM-5, the MEL structural type such as ZSM-11, the TON structural type such as theta one, and the FER structural type such as ferrierite. These various structural types are described in the $2^{nd}$ revised edition of "Atlas of Zeolite Structure Types" (1978, Butterworths, London), by W. M. Meier and D. H. Olson.

It is preferred that the large pore size zeolite component of the catalyst comprise a FAU or faujasite type, preferably a synthetic faujasite, more preferably zeolite Y. While zeolite Y may be in the rare earth form, the hydrogen form (HY), or the ultrastable (USY) form, it is preferred in the practice of the invention that it be the USY form, and particularly one with an equilibrated unit cell size no greater than 26.30 Å and preferably no greater than 24.26 Å. As is known to those skilled in the art, the USY form of faujasite is achieved by removal of the tetrahedral framework aluminum of HY, so that fewer than one-fifth of the framework sites are tetrahedral aluminum and the unit cell size is no greater than 24.26 Å. This is achieved by hydrothermal treatment of the faujasite. Cell size stabilization is achieved in high temperature, oxidative steam environments and this can be either during the catalyst manufacture or in the FCC regenerator, as is known. During equilibration, aluminum is removed from the tetrahedral framework until the presence of charge-compensating cations in non-framework positions is capable of maintaining the remaining framework aluminum ions in position, as is known. Such cations include one or more of $Al^{3+}$, $Th^{4+}$, $Zr^{4+}$, $Hf^{4+}$, the lanthanides (e.g., $La^{3+}$, $Ce^{4+}$, $Pr^{3+}$, and $Nd^{3+}$), the alkaline earth metals (e.g., $Mg^{2+}$, $Ca^{2+}$) and the alkali metals (e.g., $Li^{+}$, $Na^{+}$ and $K^{+}$). The medium pore size zeolite component preferably comprises ZSM-5.

The total amount of the catalytic zeolite components of the catalyst will range from about 1–60 wt. %, typically from 1–40 wt. % and more typically from about 5–40 wt. % of the catalyst, based on the total catalyst weight. As mentioned above, in one embodiment, which is a preferred embodiment, the catalyst will comprise a mixture of two separate particles. In this embodiment, one type of particle will comprise the large pore zeolite component composited with (e.g., dispersed in or supported on) an inorganic refractory metal oxide matrix and the other type of particle will comprise the medium pore size zeolite in an inorganic refractory metal oxide matrix. The same or different matrix material may be used for each type of catalyst particle. In the preferred embodiment, one type of catalyst particle will comprise the USY zeolite having a unit cell size less than 24.26 Å and a suitable matrix and the other type will comprise the ZSM-5 composited with the same or different matrix material. In this embodiment, it is preferred that the phosphorous component be composited with the particles containing the ZSM-5. This embodiment of two different catalyst particles used to achieve the over-all catalyst composition of the invention, permits the ZSM-5 containing catalyst particles to be added to an FCC unit loaded with a cracking catalyst comprising a large pore zeolite, such as the USY zeolite. In another embodiment, the catalyst particles may comprise both the large and medium pore zeolite components and the phosphorous component, composited with a porous, inorganic refractory metal oxide binder, in a single particle. In this embodiment, each of the two zeolite components (large pore and medium pore) may first be composited as separate particles with the same or different matrix, with these particles then composited with a binder material to form single particles comprising both zeolites in the binder material. The binder material used to form the single particle catalyst may be the same or different from that used for each of the two separate particle components. The particle size of the catalyst will typically range from about 10–300 microns, with an average particle size of about 60 microns, as is known. The inorganic refractory metal oxide used as the binder or matrix will preferably be amorphous and have acid functionality, for cracking the heavier FCC feed components. Illustrative, but non-limiting examples of amorphous, solid acid, porous matrix materials useful in the practice of the invention include alumina, silica-alumina, silica-magnesia, silica-thoria, silica-zirconia, silica-beryllia, and silica-titania, as well as ternary inorganic oxide compositions such as silica-alumina-thoria, silica-alumina-zirconia, silica-alumina-magnesia, clays such as kaolin, and the like. The matrix may also be in the form of a cogel. The catalyst of the invention may be prepared by any well-known methods useful for preparing FCC cracking catalysts.

The amount of the ZSM-5 or medium pore size zeolite in the catalyst, based on the total catalyst weight, will range from about 1–20 wt. %, preferably 2–15 wt. % and more preferably 2–8 wt. %. The ZSM-5 component is composited with at least one aluminum or alumina-containing binder material. One or more additional binder materials which do not contain aluminum or alumina may also be associated or composited with the ZSM-5 component. The amount of the USY or large pore size zeolite in the catalyst will range from about 10–50 wt. %, preferably 20–40 wt. % and more preferably 25–35 wt. %, based on the total catalyst weight. The amount of phosphorous present in the particles containing the ZSM-5, will be such_that the mole ratio of the phosphorous to the aluminum in the binder phase is between 0.1 and 10, and preferably from 0.2–5.0.

Typical cat cracking conditions in the process of the invention include a temperature of from about 800–1200° F.

(427–648° C.), preferably 850–1150° F. (454–621° C.) and still more preferably 900–1150° F. (482–621° C.), a pressure between about 5–60 psig, preferably 5–40 psig, with feed/catalyst contact times between about 0.5–15 seconds, preferably about 1–5 seconds, and with a catalyst to feed weight ratio of about 0.5–10 and preferably 2–8. The FCC feed is preheated to a temperature of not more than 850° F., preferably no greater than 800° F. and typically within the range of from about 600–800° F. The naphtha crackate recovered and recycled back into the naphtha cracking riser, is at a temperature in the range of from 200–850° F. when it is injected into the riser.

The invention will be further understood with reference to the FIGURE, in which an FCC unit 10, useful in the practice of the invention, is shown as comprising (i) two separate riser reaction zones 12 and 14, both of which terminate in the upper portion 15 of (ii) a single separation-stripping vessel 16, and (iii) a regeneration vessel 18. Riser 12 is the primary riser reactor, in which the FCC feed is cracked to form products which include naphtha and light, $C_2$–$C_4$ olefins. Riser 14 is a secondary riser in which at least a portion (e.g., ~≧20 wt. %) of the naphtha formed in riser 12, and preferably the 300° F.− boiling naphtha fraction, is cracked to form products comprising additional light, $C_2$–$C_4$ olefins. The reaction products from each riser are passed into the separation zone in vessel 16, as shown. In operation, the fluidized, hot, regenerated catalyst particles are fed from the regenerator, into risers 12 and 14, via respective transfer lines 52 and 50. The preheated FCC feed, comprising a vacuum gas oil and, optionally, also containing a resid fraction boiling above 1050° F., is injected into riser 12, via feed line 60. The feed is atomized, contacts the hot, uprising catalyst particles and is cracked to yield a spectrum of products which are gaseous at the reaction conditions, as well as some unconverted 650° F.+ feed, and coke. The cracking reaction is completed within about 5 seconds and produces spent catalyst, in addition to the reaction products. The gaseous products comprise hydrocarbons which are both gaseous and liquid at standard conditions of ambient temperature and pressure, and include light $C_2$–$C_4$ olefins, naphtha, diesel and kerosene fuel fractions, as well as unconverted 650° F.+ feed. The spent catalyst contains coke, unstrippable (hydrocarbonaceous material) and strippable hydrocarbon deposits produced by the cracking reactions. The spent catalyst particles and gaseous cracked products flow up to the top of riser 12, which terminates in a cyclone separation system, of which only a primary cyclone 22, is shown for convenience. The cyclones comprise the means for separating the spent catalyst particles from the gas and vapor reaction products. Thus, the upper portion of the vessel comprises the separation zone generally indicated as 15. These products are passed from the cyclones to the top of vessel 16, from where they are removed via line 30 and passed to further processing, including fractionation and recovery. The spent and separated catalyst particles are removed from the cyclone by means of dip leg 23 and fall down into the stripping zone 28. Recovered naphtha crackate, preferably boiling in the 60–300° F. boiling range, is preheated, mixed with steam and injected, via feed line 61 into riser 14, where it meets with and contacts the uprising and hot, regenerated catalyst particles and is cracked to form cracked products comprising additional $C_2$–$C_4$ olefins and spent catalyst particles. The spent catalyst particles and reaction products pass up into the separation vessel and into a cyclone separation system, of which only a primary cyclone 24 is shown for convenience. Not shown are the secondary cyclones associated with the primary cyclones, as is known in FCC processes. In the cyclones, the spent catalyst particles are separated from the gaseous reaction products, pass through dipleg 25 and fall down into stripping zone 28. In this preferred embodiment, the vapor and gas cracking reaction products, including the additional $C_2$–$C_4$ olefins, are removed from vessel 16 via a separate line 32 and sent to further processing and recovery. In this embodiment, a separate fractionation system may be used to recover the additional olefins. However, if desired, the naphtha cracking riser reaction products could be mixed with the FCC feed riser reaction products and this mixture, along with the stripped hydrocarbons, sent to processing. The stripping zone contains a plurality of baffles (not shown) which, as is known, are typically in the form of arrays of metal "sheds", which resemble the pitched roofs of houses. Such baffles serve to disperse the falling catalyst particles uniformly across the width of the stripping zone and minimize internal refluxing or backmixing of the particles. Alternative catalyst and vapor contacting devices such as "disk and donut" configurations may be employed in the stripping zone. A suitable stripping agent, such as steam, is introduced into the bottom of the striping zone via steam line 29 and removes as vapors, the strippable hydrocarbonaceous material deposited on the catalyst during the cracking reactions in the risers. These vapors rise up, mix and are withdrawn with the FCC feed riser product vapors, via line 30. The stripped, spent catalyst particles are fed, via transfer line 34, into the fluidized bed of catalyst 36 in regenerator 18, in which they are contacted with air or a mixture of oxygen and air, entering the regenerator via line 38. Some catalyst particles are carried up into the disengaging zone 54 of the regenerator. The oxygen bums off the carbon deposits or coke to regenerate the catalyst particles and in so doing, heats them up to a temperature typically from about 950–1450° F. The disengaging zone of the regenerator also contains cyclones (not shown) which separate the hot, regenerated catalyst particles from the gaseous combustion products (flue gas) which comprise mostly CO, $CO_2$ and steam, and returns the regenerated particles back down into the top of the fluidized bed 36, by means of diplegs (not shown). The fluidized bed is supported on a gas distributor grid, briefly indicated by dashed line 40. The hot, regenerated catalyst particles overflow the top edge 42 and 44 of funnel sections 46 and 48, of respective regenerated catalyst transfer lines 50 and 52. The top of each funnel acts as weir for the overflowing catalyst particles. The overflowing, regenerated catalyst particles flow down through the funnels and into the transfer lines, which pass them into the respective risers 14 and 12. The flue gas is removed from the top of the regenerator via line 56. The catalyst circulation rate in each riser is adjusted to give the desired catalyst to oil ratio and cracking temperature, with the catalyst circulation rate in riser 14 typically less than half of that in riser 12.

The invention will be further understood with reference to the example below.

EXAMPLE

A commercial FCC unit operating with only an FCC feed riser and a cracking catalyst which comprised a mixture of ZSM-5 and a USY zeolite-containing catalyst, was compared with the process of the invention (Base+), using data generated in pilot plants. The commercial unit was processing a vacuum gas oil feed (API=20.8), using a catalyst blend of a commercial USY-containing catalyst and a commercially available ZSM-5 catalyst. The blend contained about 34 wt. % of a USY zeolite and 0.2 wt. % ZSM-5. The MAT activity of this catalyst blend was 71. With a riser outlet temperature of 975° F. (524° C.) and a catalyst to oil weight ratio of 5, the yields obtained in the Table below, under BASE FCC, were achieved.

Two different pilot plants were used to demonstrate the improved FCC process of the invention. A circulating pilot plant was used to simulate the primary riser for cracking fresh feed and a bench scale unit was used to crack 60–430° F. boiling range naphtha produced by the circulating pilot plant unit, to simulate the second or naphtha cracking riser. A process model was used to convert the pilot plant results to equivalent heat-balanced commercial operation, for comparison with the BASE FCC process. A preferred catalyst of the invention comprising a blend of (i) 85 wt. % of a USY—containing catalyst and (ii) 15 wt. % of a catalyst containing ZSM-5 with about 18 wt. % $P_2O_5$ in the ZSM-5 containing particles, was used for the naphtha cracking. Prior to use, both catalysts of this blend were steamed to simulate hydrothermal deactivation occurring in the regenerator. The USY unit cell size stabilized at 24.26 Å. Both blend components were commercially available catalysts. The catalyst blend contained approximately 35 wt. % USY and approximately 3.8 wt. % of ZSM-5. The results are shown in the Table below for BASE+.

| CASE<br>Catalyst | BASE FCC<br>USY + lo ZSM-5 | BASE +<br>USY + 15% ZSM-5 |
|---|---|---|
| Feed rate, kB/D | 27.2 | 24.5 |
| Conv., wt. % | 72.5 | 67.3 |
| Yields, wt. % feed | | |
| H2S | 1 | 1 |
| H2 | 0.1 | 0.1 |
| C1 | 1 | 2.1 |
| C2= | 1.2 | 2.7 |
| C2 | 0.8 | 1.6 |
| C3= | 4.2 | 12.1 |
| C3 | 0.9 | 1.4 |
| C4= | 6.6 | 12.3 |
| C4 | 2.1 | 2.2 |
| Naphtha | 50.3 | 27.2 |
| Distillate | 17 | 18.7 |
| Bottoms | 10.6 | 14.0 |
| Coke | 4.2 | 4.6 |
| TOTAL | 100.0 | 100.0 |

Comparing these results shows an almost three-fold increase in propylene production using the process of the invention, at the expense of lower 430° F. (221° C.) conversion and a 10 wt. % reduction in the fresh or FCC feed rate. Also, the olefinicity of the $C_3$ fraction is a high 90 mole %, which is advantageous for propylene recovery. The results also show an almost two-fold increase in butylene production. The above table shows that the mole % of propylene based on the total moles of propane plus propylene is 90 mole %. In other words, the table shows that the mole % of propylene to total $C_3$ product is 90 mole %.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A fluid cat cracking process with increased $C_3$ olefins production which comprises the steps of:

(a) a step consisting essentially of contacting an FCC feed consisting essentially of oils having an initial boiling point greater than 232° C. (450° F.) with a particulate, hot, regenerated cracking catalyst comprising large and medium pore zeolite components in a first cracking reaction zone at reaction conditions effective to catalytically crack said feed and produce first lower boiling hydrocarbons comprising naphtha crackate boiling in the $C_5$-430° F. range, propylene-containing light olefins, and spent catalyst particles which contain strippable hydrocarbons and coke;

(b) separating said first lower boiling hydrocarbons produced in step (a) from said spent catalyst particles in a first separation zone and stripping said catalyst particles in a stripping zone, to remove said strippable hydrocarbons to produce stripped, coked catalyst particles, wherein said first separation and stripping zones are in the same vessel;

(c) separating a naphtha crackate fraction boiling in the 60–300° F. range from the first lower boiling hydrocarbons separated in step (b);

(d) contacting at least a portion of said naphtha crackate fraction produced in step (c) with said hot, regenerated, particulate cracking catalyst in a second and separate cracking reaction zone at reaction conditions effective to catalytically crack said naphtha and produce second lower boiling hydrocarbons comprising more propylene-containing light olefins, and spent catalyst particles which contain strippable hydrocarbons and coke;

(e) separating said second lower boiling hydrocarbons from said spent catalyst particles in a second and separate separation zone and stripping said particles in said stripping zone, to remove said strippable hydrocarbons to produce stripped, coked catalyst particles, provided that said second lower boiling hydrocarbons separated in said separate separation zone are not mixed with first riser reaction products;

(f) passing said stripped, coked catalyst particles produced in steps (b) and (e) into a regeneration zone in which said particles are contacted with oxygen at conditions effective to bum off said coke and produce said hot, regenerated catalyst particles;

(g) passing said hot, regenerated particles into said first and second cracking reaction zones, each of which is in a separate riser; and, (h) passing said first lower boiling hydrocarbons from said first separation zone and said second lower boiling hydrocarbons from said second separation zone to a fractionation system for further processing, wherein the process conditions in the first and second cracking reaction zones are such that propylene comprises at least 90 mol % of the total $C_3$ products in the first and second lower boiling hydrocarbons.

2. A process according to claim 1 wherein said catalyst also comprises at least one inorganic refractory metal oxide binder material.

3. A process according to claim 2 wherein said binder material has an acid cracking function.

4. A process according to claim 3 wherein said large pore zeolite component has an internal porous cell structure having cross-sectional dimensions ranging from 6 to 8 Å.

5. A process according to claim 4 wherein said medium pore zeolite component has an internal porous cell structure having cross-sectional dimensions ranging from 4 to 6 Å.

6. A process according to claim 5 wherein said catalyst includes a phosphorous component.

7. A process according to claim 6 wherein the respective pore sizes of said large and medium pore zeolites range from 6.5–7.6 Å and 6.4–5.4 Å.

8. A process according to claim 7 wherein said large pore zeolite comprises a USY zeolite and said medium pore zeolite comprises ZSM-5.

9. A process according to claim 8 wherein more than 75 wt. % of said naphtha feed boils within the range of from 60–300° F.

10. A process according to claim 6 wherein said contacting occurs in the presence of steam added to said second cracking reaction zone.

11. A fluid cat cracking process with increased $C_3$ olefins production which comprises the steps of:

(a) a step consisting essentially of contacting an FCC feed consisting essentially of oils having an initial boiling point greater than 232° C. (450° F.) with a particulate, hot regenerated cracking catalyst comprising USY and ZSM-5 zeolite catalytic components and a porous, amorphous, inorganic refractory metal oxide having an acid cracking function, in a first cracking reaction zone at reaction conditions effective to catalytically crack said feed and produce first lower boiling hydrocarbons comprising naphtha crackate boiling in the $C_5$ - 43° F. range, propylene-containing light olefins, and spent catalyst particles which contain strippable hydrocarbons and coke;

(b) separating said first lower boiling hydrocarbons produced in step (a) from said spent catalyst particles in a first separation zone and stripping said catalyst particles in a stripping zone, to remove said strippable hydrocarbons to produce stripped, coked catalyst particles, wherein said first separation and stripping zones are in the same vessel;

(c) separating a naphtha crackate fraction boiling in the 60–300 W range from the first lower boiling hydrocarbons separated in step (b);

(d) contacting at least a portion of said naphtha crackate fraction produced in step (c) with said hot, regenerated, particulate cracking catalyst in a second cracking reaction zone at reaction conditions effective to catalytically crack said naphtha and produce second lower boiling hydrocarbons comprising more propylene-containing light olefins, and spent catalyst particles which contain strippable hydrocarbons and coke;

(e) separating said second lower boiling hydrocarbons from said spent catalyst particles in a second and separate separation zone and stripping said particles in said stripping zone, to remove said shippable hydrocarbons to produce stripped, coked catalyst particles, provided that said second lower boiling hydrocarbons separated in said separate separation zone are not mixed with first riser reaction products;

(f) passing said stripped, coked catalyst particles produced in steps (b) and (e) into a regeneration zone in which said particles are contacted with oxygen at conditions effective to bum off said coke and produce said hot, regenerated catalyst particles;

(g) passing said hot, regenerated particles into said first and second cracking reaction zones, each of which is in a separate riser; and, (h) passing said first lower boiling hydrocarbons from said first separation zone and said second lower boiling hydrocarbons from said second separation zone to a fractionation system for further processing, wherein the process conditions in the first and second cracking reaction zones are such tat propylene comprises at least 90 mol % of the total $C_3$ products in the first and second lower boiling hydrocarbons.

12. A process according to claim 11 wherein said USY zeolite has an equilibrated unit cell size no greater than 24.30 Å.

13. A process according to claim 12 wherein said catalyst also comprises a phosphorous component.

14. A process according to claim 13 wherein said catalyst comprises an admixture of particles comprising said USY zeolite and particles containing said ZSM-5 zeolite.

15. A process according to claim 14 wherein the amounts of said ZSM-5 and USY zeolites respectively comprise from 1–20 wt. % and from 10–50 wt. % of said catalyst, based on die total weight of the catalyst.

16. A process according to claim 15 wherein said phosphorous component is contained in an aluminum-containing binder component of said particles containing said ZSM-5.

17. A process according to claim 16 wherein said USY zeolite has an equilibrated unit cell size no greater than 24.26 Å.

18. A process according to claim 16 wherein said phosphorous present m said binder component in an amount such that the binder P/A1 mole ratio lies between 0.1 and 10.

19. A process according to claim 18 wherein said P/A1 mole ratio is between 0.2 and 5.0.

20. A process according to claim 11 wherein said contacting occurs in the presence of steam added to said second cracking reaction zone.

21. A method for improving the propylene productivity of a fluid cat cracking unit which produces a crackate comprising propylene and naphtha, said naphtha crackate comprising a lower boiling fraction which boils in the range of from 60–300° F., from a fluid cat cracking feed consisting of essentially oils, having an initial boiling point greater than 232° C. (450° F.) said unit comprising (i) a single regenerator vessel, (ii) a single combined separator-stripper vessel, (iii) at least one riser reaction zone for catalytically cracking said feed and (iv) a particulate cracking catalyst comprising a USY zeolite and an amorphous binder material, said method comprising:

(a) adding at least one separate riser to said unit;

(b) adding a particulate catalyst comprising ZSM-5 to said cracking catalyst in said unit to form a combined particulate catalyst;

(c) recovering from a first separation zone at least a portion of said naphtha crackate comprising a fraction which boils in the range of from 60–300° F. and containing less than 10 wt.% of components boiling above 300° F. and feeding it into said separate riser terminating in a second separation zone, in which the portion of said naphtha crackate contacts said combined catalyst particles at reaction conditions effective to catalytically crack said naphtha and produce more propylene, provided that reaction products from second separation zone are not mixed with reaction products from said first separation zone;

wherein the process conditions in the first and second cracking reaction zones are such that propylene comprises at least 90 mol % of the total $C_3$ products in the first and second lower boiling hydrocarbons.

22. A method according to claim 21 wherein said ZSM-5 catalyst includes an aluminum and a phosphorus component, in which the P/A1 mole ratio ranges between 0.1 and 10.

23. The method according to claim 21 further comprising the step of passing the hydrocarbons separated from said cracking catalyst in said first separation zone and the hydrocarbons separated from said cracking catalyst in said second separation zone to separate fractionation systems for further processing.

* * * * *